US012042690B2

(12) United States Patent
Hsu

(10) Patent No.: US 12,042,690 B2
(45) Date of Patent: Jul. 23, 2024

(54) CLIMBING MACHINE STRUCTURE

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 11 days.

(21) Appl. No.: 17/707,028

(22) Filed: Mar. 29, 2022

(65) Prior Publication Data

US 2023/0310925 A1 Oct. 5, 2023

(51) Int. Cl.

| | |
|---|---|
| ***A63B 22/00*** | (2006.01) |
| ***A63B 21/00*** | (2006.01) |
| ***A63B 22/20*** | (2006.01) |

(52) U.S. Cl.

CPC ..... *A63B 22/001* (2013.01); *A63B 21/00069* (2013.01); *A63B 21/154* (2013.01); *A63B 22/0025* (2015.10); *A63B 22/205* (2013.01); *A63B 2022/0043* (2013.01)

(58) Field of Classification Search

CPC . A63B 22/001; A63B 22/0025; A63B 22/205; A63B 22/04; A63B 21/00069; A63B 21/154; A63B 2022/0043

See application file for complete search history.

(56) References Cited

U.S. PATENT DOCUMENTS

| | | | | |
|---|---|---|---|---|
| 5,040,785 | A * | 8/1991 | Charnitski | A63B 23/0417 482/52 |
| 5,492,515 | A * | 2/1996 | Charnitski | A63B 22/205 482/37 |
| 10,758,776 | B2 | 9/2020 | Chen | |
| 11,077,336 | B2 * | 8/2021 | Carruthers | A63B 22/001 |
| 11,235,197 | B2 * | 2/2022 | Carruthers | A63B 22/04 |
| 11,426,622 | B2 * | 8/2022 | Carruthers | A63B 71/0622 |
| 2022/0395735 | A1 * | 12/2022 | Sun | A63B 22/0005 |
| 2023/0233899 | A1 * | 7/2023 | Lin | A63B 21/4045 482/52 |

FOREIGN PATENT DOCUMENTS

| | | |
|---|---|---|
| CN | 207980351 U | 10/2018 |
| CN | 210205813 U | 3/2020 |

* cited by examiner

*Primary Examiner* — Loan B Jimenez
*Assistant Examiner* — Kathleen M Fisk
(74) *Attorney, Agent, or Firm* — Rosenberg, Klein & Lee

(57) ABSTRACT

The climbing machine structure includes a support frame, a first slide rail unit, a second slide rail unit, a first pedal, a second pedal, a first handle, a second handle, and a transmission unit. The first slide rail unit and the second slide rail unit are juxtaposed on the support frame. A first top end of the first slide rail unit and a second top end of the second slide rail unit are lower than an eye position of the operator in the height direction. Thereby, the line of sight of the operator won't be blocked.

8 Claims, 18 Drawing Sheets

CLIMBING MACHINE STRUCTURE

FIELD OF THE INVENTION

The present invention relates to a climbing machine structure, and more particularly to a climbing machine structure able to reduce the height of slide rails.

BACKGROUND OF THE INVENTION

A climbing machine is a common exercise machine, which includes displaceable pedals and handles disposed on vertical rails. The operator alternately treads on the pedals with both feet and grasps the handles with both hands to simulate rock climbing, so that the operator can practice the coordinated movements of hands and feet for rock climbing, achieving the sports and fitness effect.

Chinese Utility Model Publication No. CN210205813U discloses a climbing machine, and U.S. patent Publication Ser. No. 10/758,776B2 discloses a column-type combination climbing exercise machine.

As disclosed in Chinese Utility Model Publication No. CN210205813U, the climbing machine has a connecting frame that can be reciprocated up and down relative to a machine frame. The connecting frame is provided with handles and pedals. The handles and the pedals are disposed on the same connecting frame. For the operator to grasp the handles and for the pedals to be reciprocated, the connecting frame is higher. Besides, in order to maintain the balance of the climbing machine, the connecting frame is disposed at the center of the climbing machine, so the connecting frame may block the line of sight of the operator.

As disclosed in U.S. patent Publication Ser. No. 10/758,776B2, the handles and the pedals are disposed at both ends of the same column. Like the problems in Chinese Utility Model Publication No. CN210205813U, the column is high, and the line of sight of the operator is blocked by the column.

Taking the aforementioned patent CN210205813U as an example, since the line of sight of the operator is blocked, once a display screen is installed on the climbing machine, if the display screen is installed on the side of the connecting frame away from the operator, the display screen will be blocked by the connecting frame. If the display screen is installed on the side of the connecting frame close to the operator, the display screen will be too close to the operator for the operator to watch a program. Even if the display screen is disposed on the side as disclosed in the aforementioned U.S. Pat. No. 10,758,776B2, the operator still has to turn his/her head for watching a program. It is inconvenient in use.

SUMMARY OF THE INVENTION

In order to solve the above-mentioned problem that the line of sight of the operator is blocked, the primary object of the present invention is to provide a climbing machine structure for an operator to operate the climbing machine structure in a standing position. An extending direction of the operator's body is defined as a height direction. The climbing machine structure comprises a support frame, a first slide rail unit, a second slide rail unit, a first pedal, a second pedal, a first handle, a second handle, and a transmission unit. The support frame has a first side and a second side. The first slide rail unit is disposed on the first side of the support frame. The second slide rail unit is disposed on the second side of the support frame. The first pedal is slidably connected to the first slide rail unit. The second pedal is slidably connected to the second slide rail unit. The first handle is slidably connected to the first slide rail unit. The second handle is slidably connected to the second slide rail unit. The transmission unit is disposed on the first side and the second side of the support frame. The transmission unit includes a first belt and a second belt that are linked with each other. The first belt and the second belt are looped along the height direction to be moved relative to the support frame. The first pedal, the second pedal, the first handle and the second handle are connected to the first belt and the second belt respectively, such that the first pedal, the second pedal, the first handle and the second handle are driven by the transmission unit to slide back and forth on the first slide rail unit and the second slide rail unit, respectively. The first slide rail unit has a first top end. The second slide rail unit has a second top end. The first top end and the second top end are lower than an eye position of the operator in the height direction.

Preferably, the transmission unit further includes a first pulley, a second pulley, a third pulley, a fourth pulley and a rotating shaft. The first pulley and the second pulley are located on the first side of the support frame. The third pulley and the fourth pulley are located on the second side of the support frame. The first belt is looped around the first pulley and the second pulley. The second belt is looped around the third pulley and the fourth pulley. The second pulley and the fourth pulley are connected to the rotating shaft to rotate back and forth synchronously. The rotating shaft is disposed on the support frame and is rotatable relative to the support frame.

Preferably, the first belt includes a first far section and a first near section. The first far section is away from the operator. The first near section is close to the operator. The first far section and the first near section are moved in opposite directions. The second belt includes a second far section and a second near section. The second far section is away from the operator. The second near section is close to the operator. The second far section and the second near section are moved in opposite directions. The first pedal is provided with a first slide block. The first slide block is connected to the first near section through a first connecting member. The second pedal is provided with a second slide block. The second slide block is connected to the second far section through a second connecting member. The first handle is provided with a third slide block. The third slide block is connected to the first far section through a third connecting member. The second handle is provided with a fourth slide block. The fourth slide block is connected to the first near section through a fourth connecting member.

Preferably, the first slide rail unit includes a first near slide rail and a first far slide rail. The first near slide rail is close to the operator. The first far slide rail is away from the operator. The second slide rail unit includes a second near slide rail and a second far slide rail. The second near slide rail is close to the operator. The second far slide rail is away from the operator. The first slide block slides on the first near slide rail. The second slide block slides on the second near slide rail. The third slide block slides on the first far slide rail. The fourth slide block slides on the second far slide rail.

Preferably, the first slide block, the second slide block, the third slide block and the fourth slide block each include at least one roller. The roller is configured to roll in the first slide rail unit and the second slide rail unit so that the first slide block, the second slide block, the third slide block and the fourth slide block slide relative to the first slide rail unit and the second slide rail unit, respectively.

Alternatively, the first slide block, the second slide block, the third slide block and the fourth slide block each include at least one bushing. The bushing is configured to be sleeved on the first slide rail unit and the second slide rail unit so that the first slide block, the second slide block, the third slide block and the fourth slide block slide relative to the first slide rail unit and the second slide rail unit, respectively.

Preferably, the climbing machine structure further comprises a resistance unit disposed on the support frame. The resistance unit includes a driving wheel, a driven wheel, a small driven wheel, a resistance wheel, a third belt, a fourth belt, and a resistance member. The driving wheel is connected to the rotating shaft. The driven wheel and the small driven wheel are coaxial and rotated synchronously. The small driven wheel is connected with the driving wheel via the third belt. The driven wheel is connected with the resistance wheel via the fourth belt. The resistance member is movable relative to the resistance wheel. The second pulley and the fourth pulley drive the driving wheel to rotate back and forth through the rotating shaft. The driving wheel drives the resistance wheel to rotate through the third belt, the small driven wheel, the driven wheel and the fourth belt. The resistance member is configured to apply a resistance to the resistance wheel. The resistance is transmitted to the second pulley and the fourth pulley through the resistance unit. The resistance is further applied to the first pedal, the second pedal, the first handle and the second handle.

Preferably, the resistance member is a magnetic resistance member. The resistance unit further includes a control member disposed on the support frame. The control member is connected to the magnetic resistance member. The position of the magnetic resistance member is controlled by the control member to change the magnitude of the resistance.

Preferably, the support frame further includes a display screen stand. A display screen is disposed on the display screen stand. The display screen corresponds to the eye position of the operator in the height direction.

Preferably, the support frame includes a post and a base. The height direction is a Z direction. An X direction and a Y direction are perpendicular to the Z direction. The X direction and the Y direction are perpendicular to each other. The X direction is a direction extending along the operator's body width. The X direction and the Y direction constitute an XY plane. The post extends obliquely along the Z direction. The post has a post top end. The post top end is lower than the eye position of the operator in the height direction. The base is located on the XY plane. The first slide rail unit and the second slide rail unit are disposed on the post. The first pedal and the second pedal are spaced by a distance in the X direction. The first handle and the second handle are spaced by another distance in the X direction.

According to the above technical features, the following effects can be preferably achieved.

1. Through the first slide rail unit and the second slide rail unit that are juxtaposed on the support frame, the first top end of the first slide rail unit and the second top end of the second slide rail unit are lower than the eye position of the operator in the height direction. Thereby, the line of sight of the operator won't be blocked by the first slide rail unit and the second slide rail unit.
2. With the structure of the first belt and the second belt and the connection of each element, the climbing machine structure allows the operator's left foot and right foot to alternately tread on the first and second pedals. The right hand and left foot of the operator A move up and down synchronously, and the left hand and right foot move up and down synchronously. This is more in line with actual exercise habits.
3. The training effect can be enhanced by the resistance provided by the resistance unit.
4. The magnitude of the resistance can be adjusted according to the operator's own needs by operating the control member.
5. Each pedal or handle has its own slide block and roller to ensure that the pedal or handle slides smoothly and stably along the first slide rail unit or the second slide rail unit.
6. With the display screen stand extending away from the operator, the display screen corresponds to the operator's eye position in the height direction and keeps a proper distance from the operator, so as to reduce the burden on the eyes of the operator.
7. The first slide rail unit and the second slide rail unit are arranged on the first side and the second side of the support frame in a balanced manner, which is beneficial for stable operation and reduces the volume of the climbing machine effectively.

DESCRIPTION OF THE PREFERRED EMBODIMENTS

Embodiments of the present invention will now be described, by way of example only, with reference to the accompanying drawings.

Figure 1:
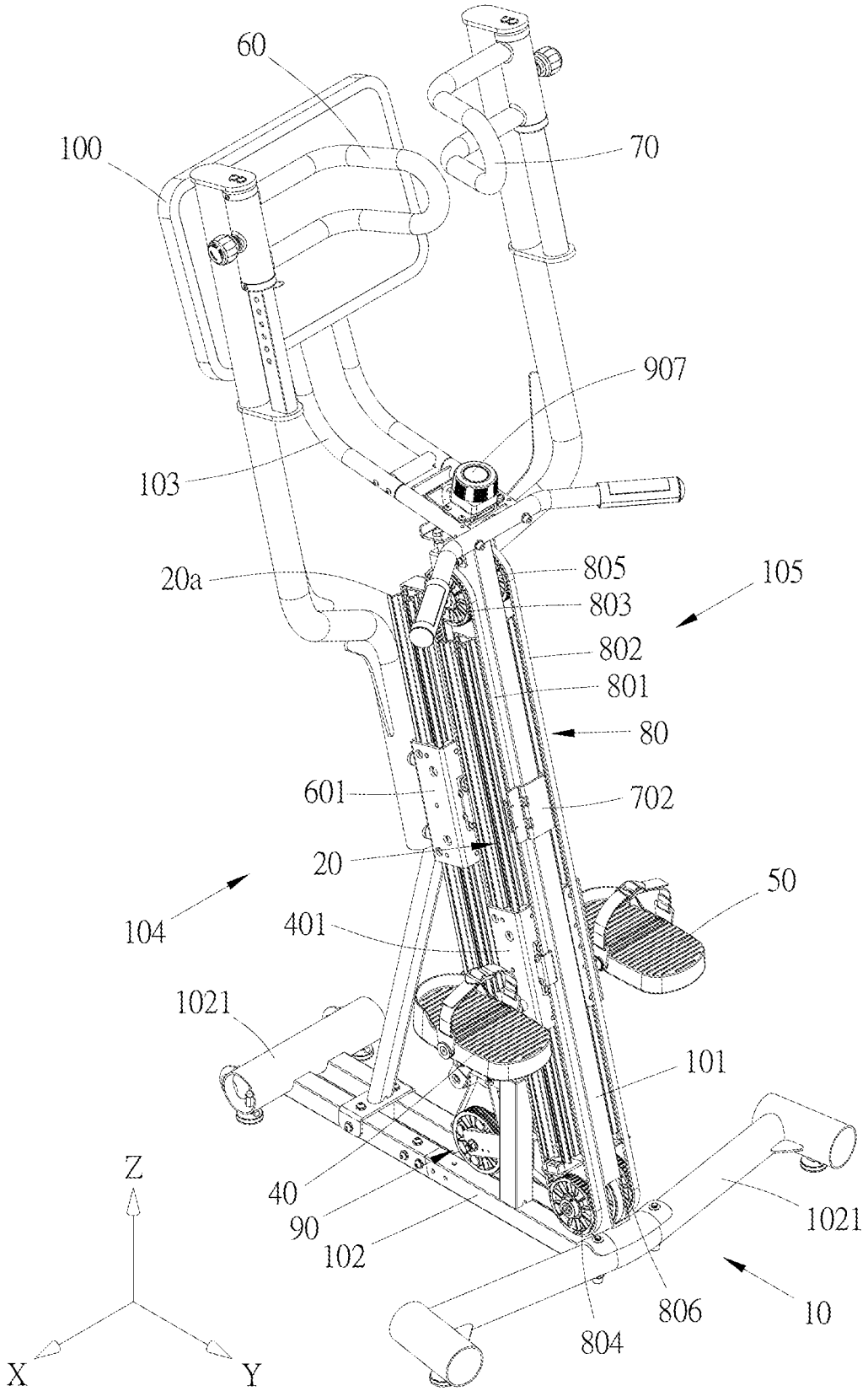
FIG. 1 is a perspective view according to a first embodiment of the present invention seen from the first side direction.
Figure 2:
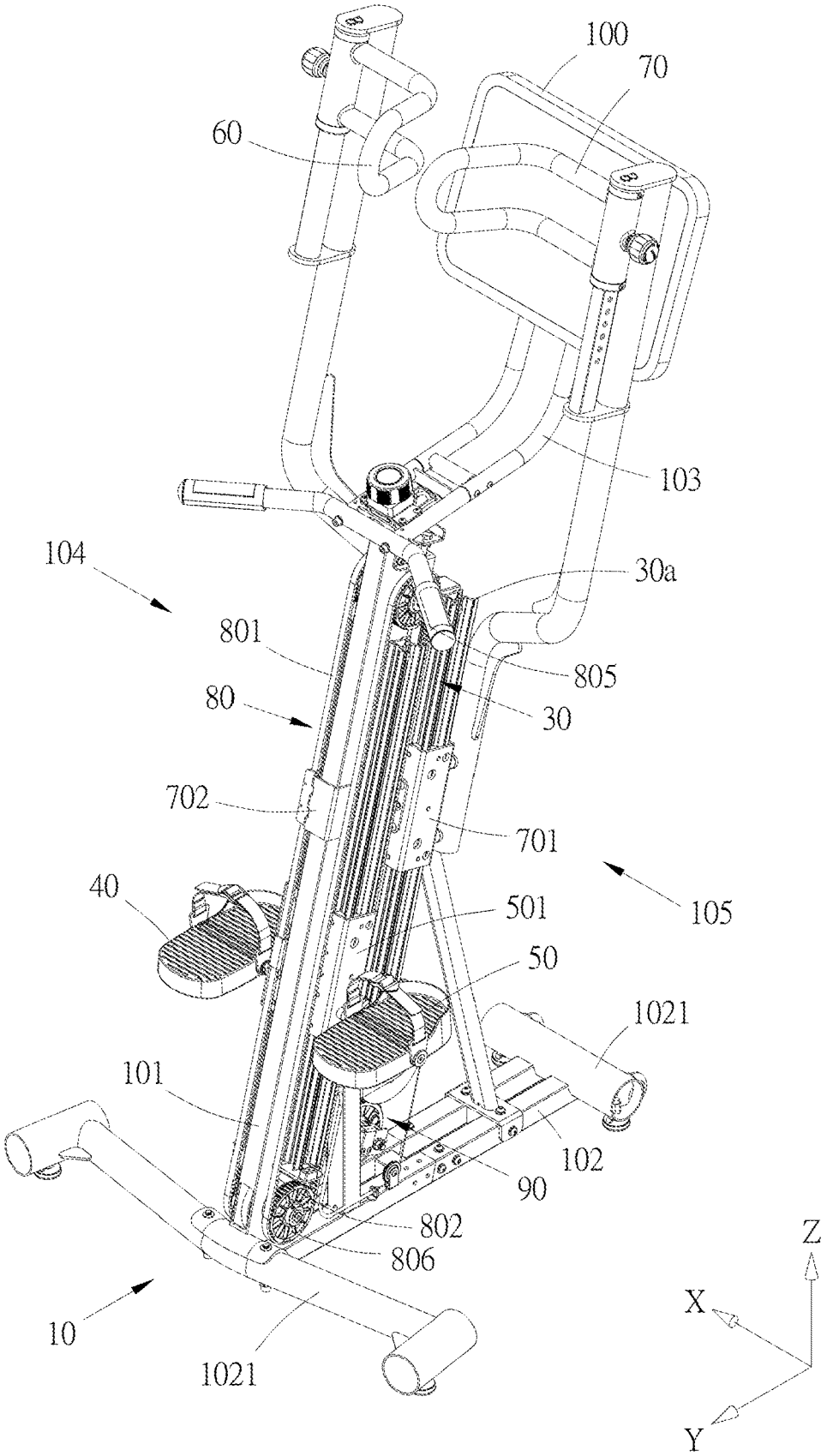
FIG. 2 is a perspective view according to the first embodiment of the present invention seen from the second side direction.
Figure 3:
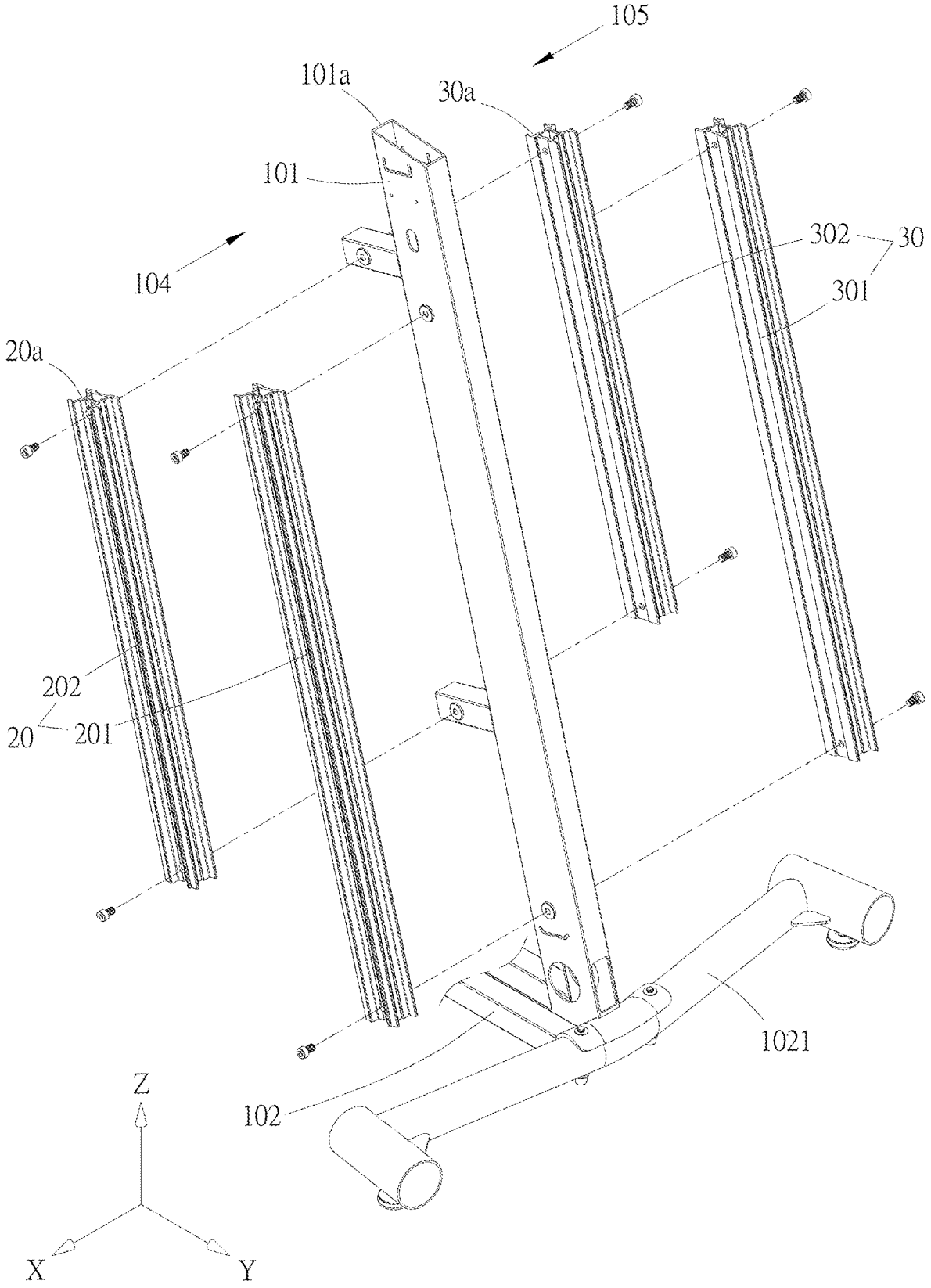
FIG. 3 is a partial exploded view according to the first embodiment of the present invention, illustrating the support frame, the first slide rail unit and the second slide rail unit.
Figure 14:
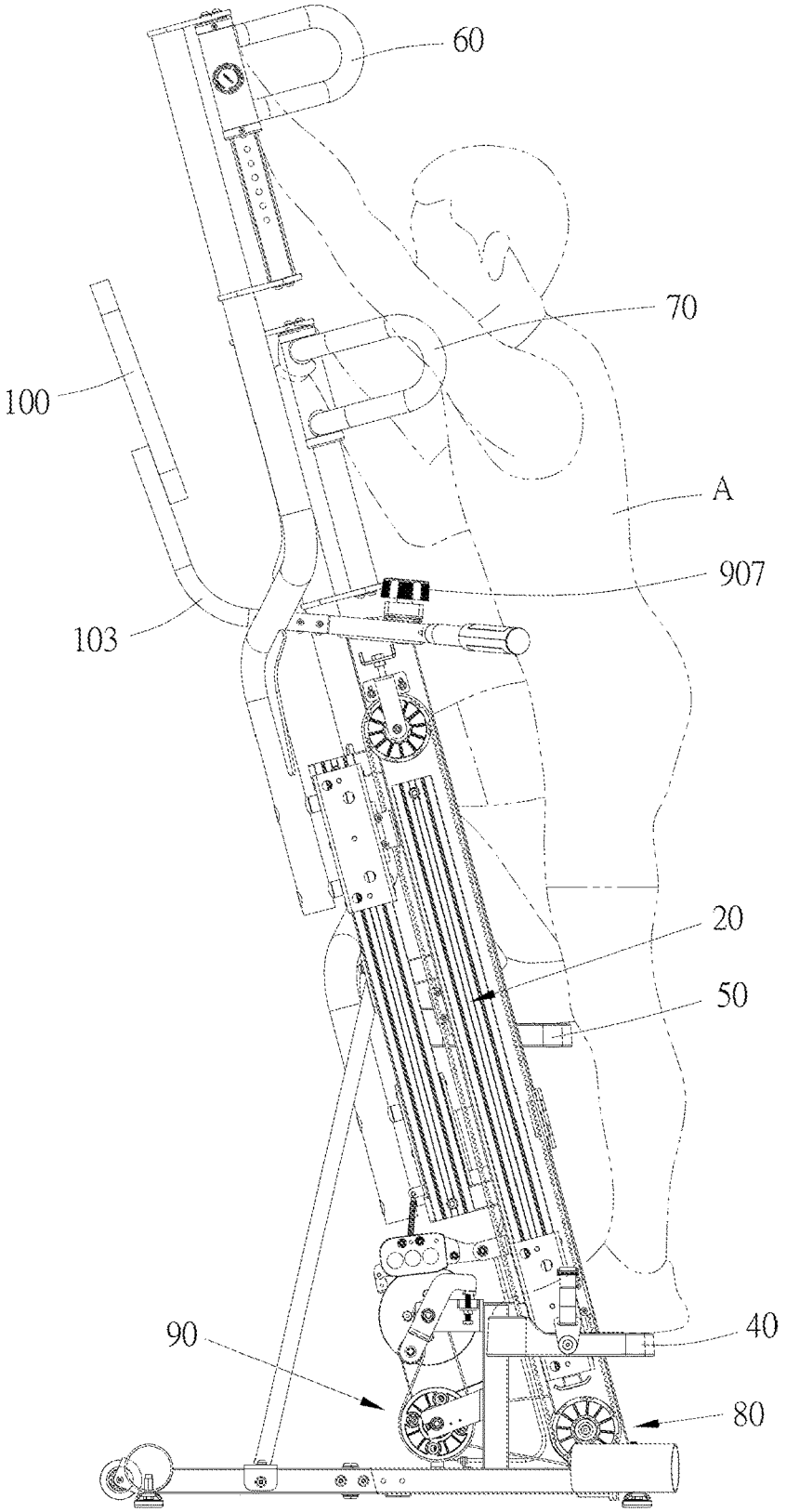
FIG. 14 is a schematic view according to the first embodiment of the present invention when in use, illustrating that the operator operates the climbing machine structure.

FIGS. 1-3 illustrate a first embodiment of the present invention. The present invention discloses a climbing machine structure for an operator A (as shown in FIG. 14) to operate the climbing machine structure in a standing position. When the operator A operates the climbing machine structure in a standing position, the extending direction of the operator's body is defined as a height direction. The following terms, such as left and right, up and down, body width, near and far, are all based on the position of the operator A in an operating state.

The climbing machine structure includes a support frame 10, a first slide rail unit 20, a second slide rail unit 30, a first pedal 40, a second pedal 50, a first handle 60, a second handle 70, a transmission unit 80, a resistance unit 90, and a display screen 100. The first pedal 40 and the first handle 60 are slidably connected to the first slide rail unit 20. The second pedal 50 and the second handle 70 are slidably connected to the second slide rail unit 30.

The support frame 10 includes a post 101, a base 102, and a display screen stand 103. The post 101 extends obliquely along a Z direction (i.e., the height direction). The base 102 is disposed on an XY plane perpendicular to the Z direction. The XY plane is formed by an X direction and a Y direction which are perpendicular to each other. The X direction is a direction extending along the operator's body width. The display screen stand 103 is inclined upward from the post 101 in a direction away from the operator A. In the X direction, the support frame 10 defines a first side 104 on its left side and a second side 105 on its right side.

The display screen 100 is disposed on the display screen stand 103. The display screen 100 corresponds to an eye position of the operator A in the height direction. Because the display screen stand 103 is inclined upward in a direction away from the operator A, in addition to corresponding to the eye position of the operator A, the display screen 100 also keeps an appropriate distance from the operator A to reduce the burden on the eyes of the operator A.

Preferably, the base 102 includes two support rods 1021 that are juxtaposed in the Y direction. The support rods 1021 extend along the X direction. According to the position of the center of gravity of the climbing machine structure, the support rods 1021 may have different lengths and appearances, so as to ensure the stability of the climbing machine structure and the operation safety of the operator A.

The first slide rail unit 20 and the second slide rail unit 30 are disposed on the post 101. The first slide rail unit 20 and the second slide rail unit 30 are juxtaposed on the post 101 in the X direction, so that the first slide rail unit 20 is located on the first side 104 and the second slide rail unit 30 is located on the second side 105.

Preferably, the first slide rail unit 20 has a first top end 20*a* that is the highest in the height direction, and the second slide rail unit 30 has a second top end 30*a* that is the highest in the height direction. The post 101 has a post top end 101*a* that is the highest in the height direction. The first top end 20*a*, the second top end 30*a* and the post top end 101*a* are all lower than the eye position of the operator A in the height direction.

In this embodiment, the first slide rail unit 20 and the second slide rail unit 30 each include two juxtaposed slide rails in the Y direction. The first slide rail unit 20 includes a first near slide rail 201 close to the operator A and a first far slide rail 202 away from the operator A. The second slide rail unit 30 includes a second near slide rail 301 close to the operator A and a second far slide rail 302 away from the operator A. In this embodiment, after the first far slide rail 202 and the first near slide rail 201 are fixed to the post 101, the upper end of the first far slide rail 202 is slightly higher than the upper end of the first near slide rail 201 in the height direction. Thus, the first top end 20*a* of the first slide rail unit 20 refers to the upper end of the first far slide rail 202. Similarly, the upper end of the second far slide rail 302 is slightly higher than the upper end of the second near slide rail 301 in the height direction. Thus, the second top end 30*a* of the second slide rail unit 30 refers to the upper end of the second far slide rail 302.

Figure 4:
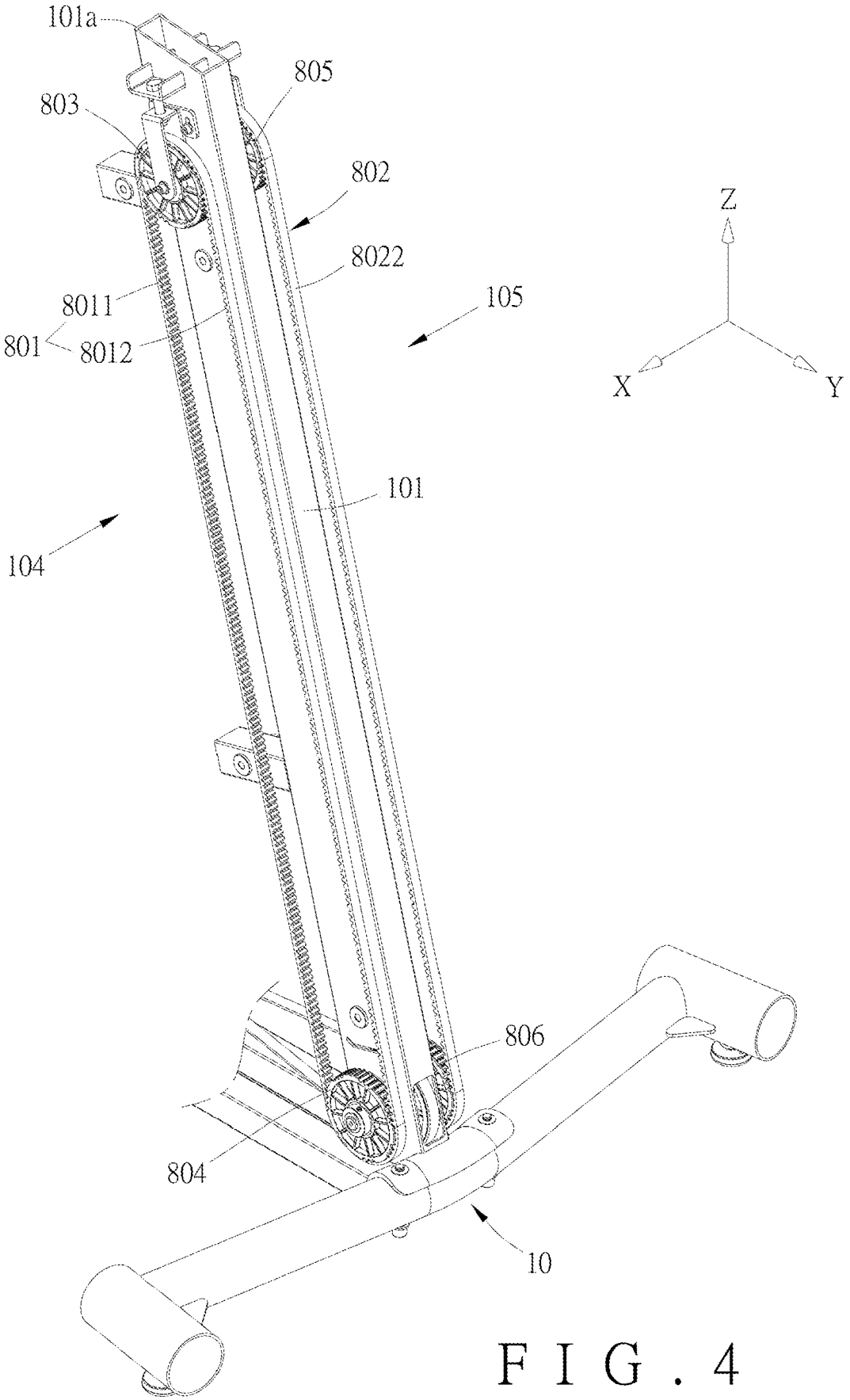
FIG. 4 is a partial perspective view according to the first embodiment of the present invention, illustrating the support frame, the first belt and the second belt.
Figure 5:
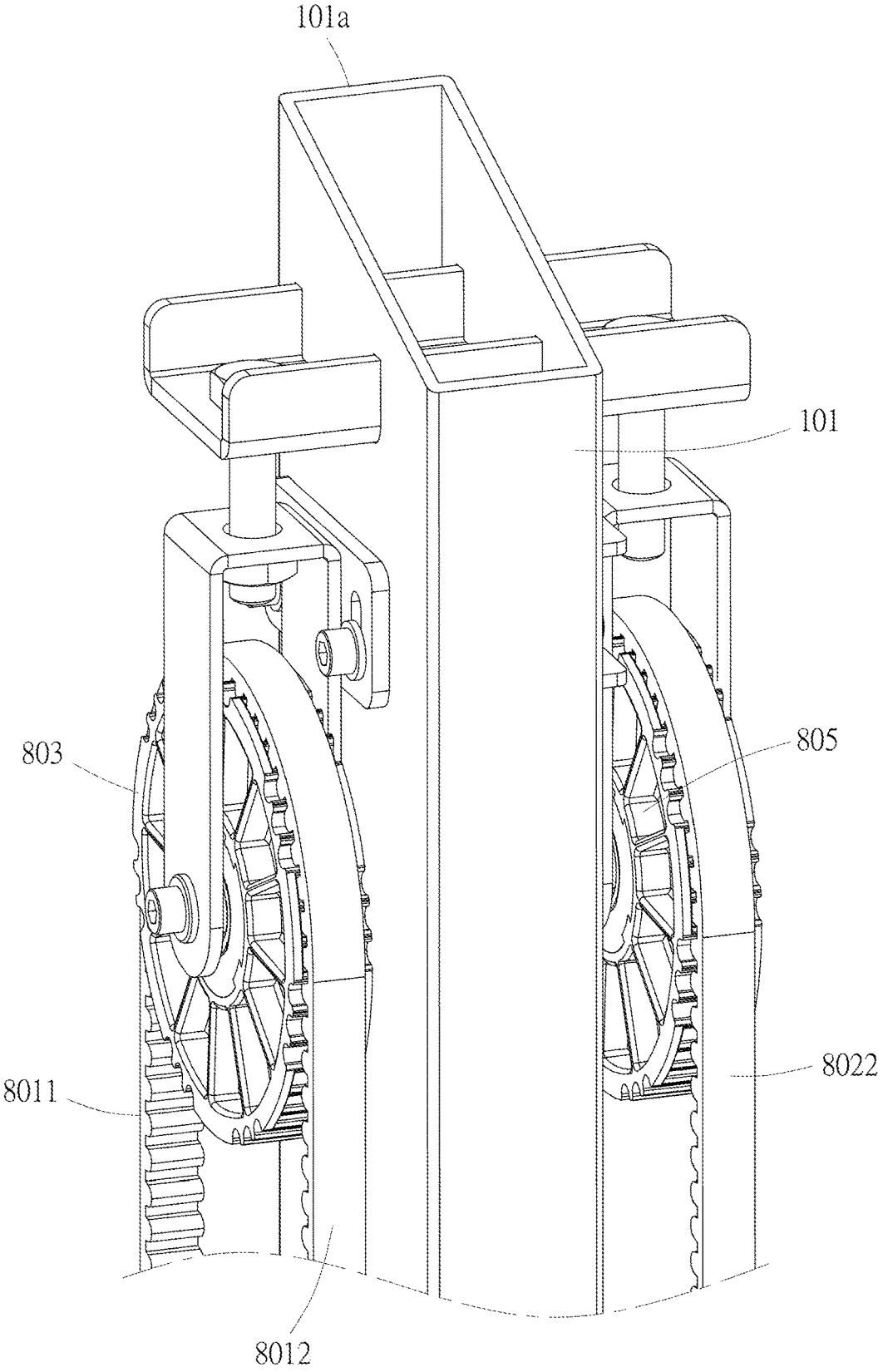
FIG. 5 is a partial enlarged view according to the first embodiment of the present invention, illustrating the first pulley and the second pulley coupled to the support frame.

Please refer to FIG. 1, FIG. 4 and FIG. 5. The transmission unit 80 is disposed on the first side 104 and the second side 105 of the support frame 10. The transmission unit 80 includes a first belt 801 and a second belt 802 that are linked with each other. The first belt 801 and the second belt 802 are located on the first side 104 and the second side 105, respectively. The first belt 801 and the second belt 802 are looped along the height direction to be rotated back and forth relative to the support frame 10.

In this embodiment, the first belt 801 includes a first far section 8011 away from the operator A (referring to FIG. 14) and a first near section 8012 close to the operator A. The first far section 8011 and the first near section 8012 are moved in opposite directions. The second belt 802 includes a second far section 8021 away from the operator A and a second near section 8022 (referring to FIG. 6) close to the operator A. The second far section 8021 and the second near section 8022 are also moved in opposite directions.

Figure 6:
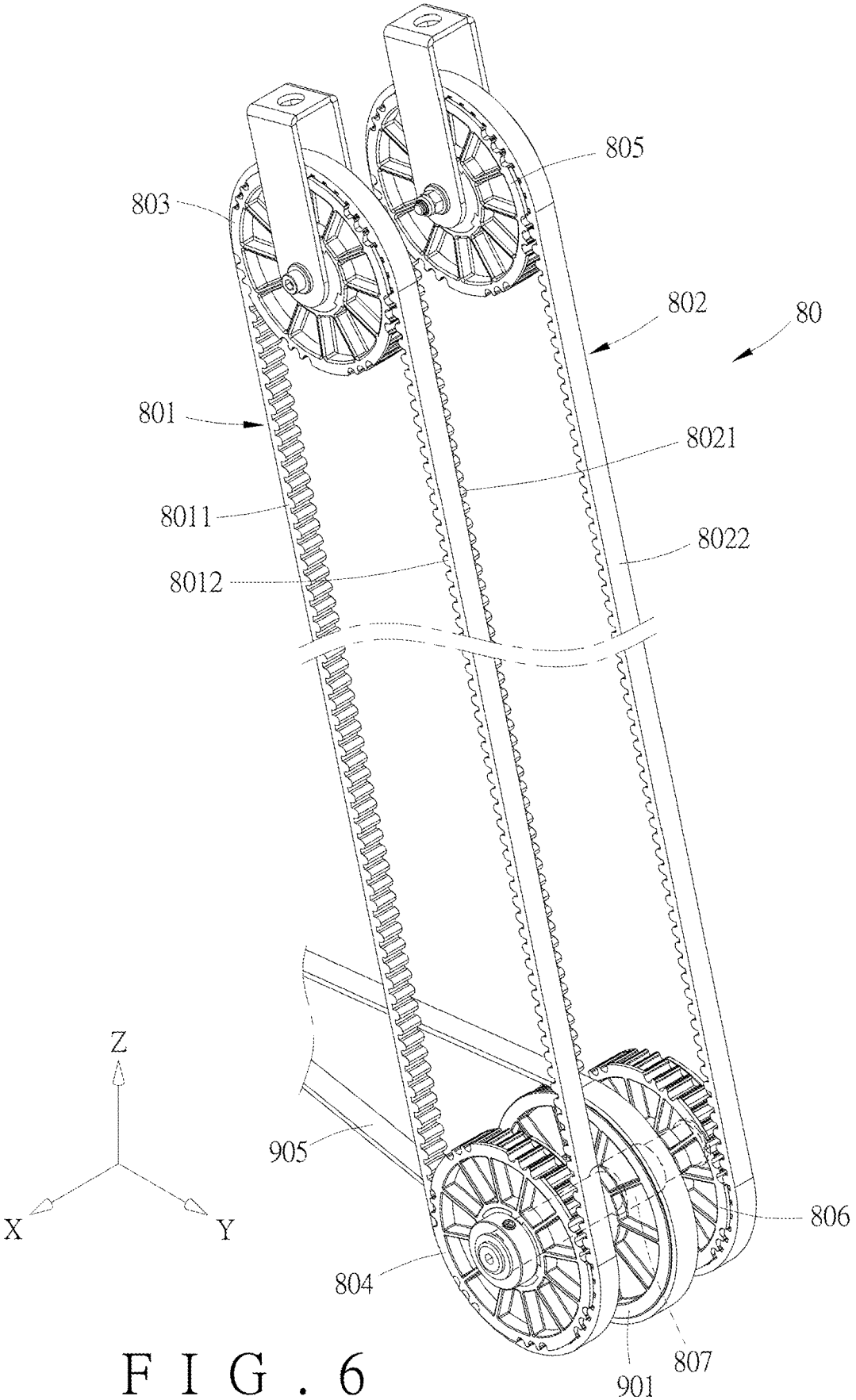
FIG. 6 is a first schematic view according to the first embodiment of the present invention, illustrating the transmission unit.

Please refer to FIGS. 4 to 6. The transmission unit 80 further includes a first pulley 803, a second pulley 804, a third pulley 805, a fourth pulley 806, and a rotating shaft 807.

The first pulley 803 is independently pivoted to the upper section of the post 101 on the first side 104. The second pulley 804 is connected to the rotating shaft 807 on the first side 104. The rotating shaft 807 is pivotally connected to the lower section of the post 101. The rotating shaft 807 is rotatable relative to the post 101. The third pulley 805 is independently pivoted to the upper section of the post 101 on the second side 105. The fourth pulley 806 is connected to the rotating shaft 807 on the second side 105. The first belt 801 is looped around the first pulley 803 and the second pulley 804. The second belt 802 is looped around the third pulley 805 and the fourth pulley 806. Because both the second pulley 804 and the fourth pulley 806 are connected to the rotating shaft 807, the second pulley 804, the rotating shaft 807 and the fourth pulley 806 rotate back and forth synchronously, thereby enabling the first belt 801 and the second belt 802 to rotate back and forth synchronously.

Please refer to FIG. 1, FIG. 7, FIG. 8 and FIG. 9. The first pedal 40 is provided with a first slide block 401. The first slide block 401 is connected to the first near section 8012 through a first connecting member 402. The second pedal 50 is provided with a second slide block 501. The second slide block 501 is connected to the second far section 8021 through a second connecting member 502. The first handle 60 is provided with a third slide block 601. The third slide block 601 is connected to the first far section 8011 through a third connecting member 602. The second handle 70 is provided with a fourth slide block 701. The fourth slide block 701 is connected to the first near section 8012 through a fourth connecting member 702.

The first slide block 401, the second slide block 501, the third slide block 601 and the fourth slide block 701 each include at least one roller 403, 503, 603, 703.

Figure 8:
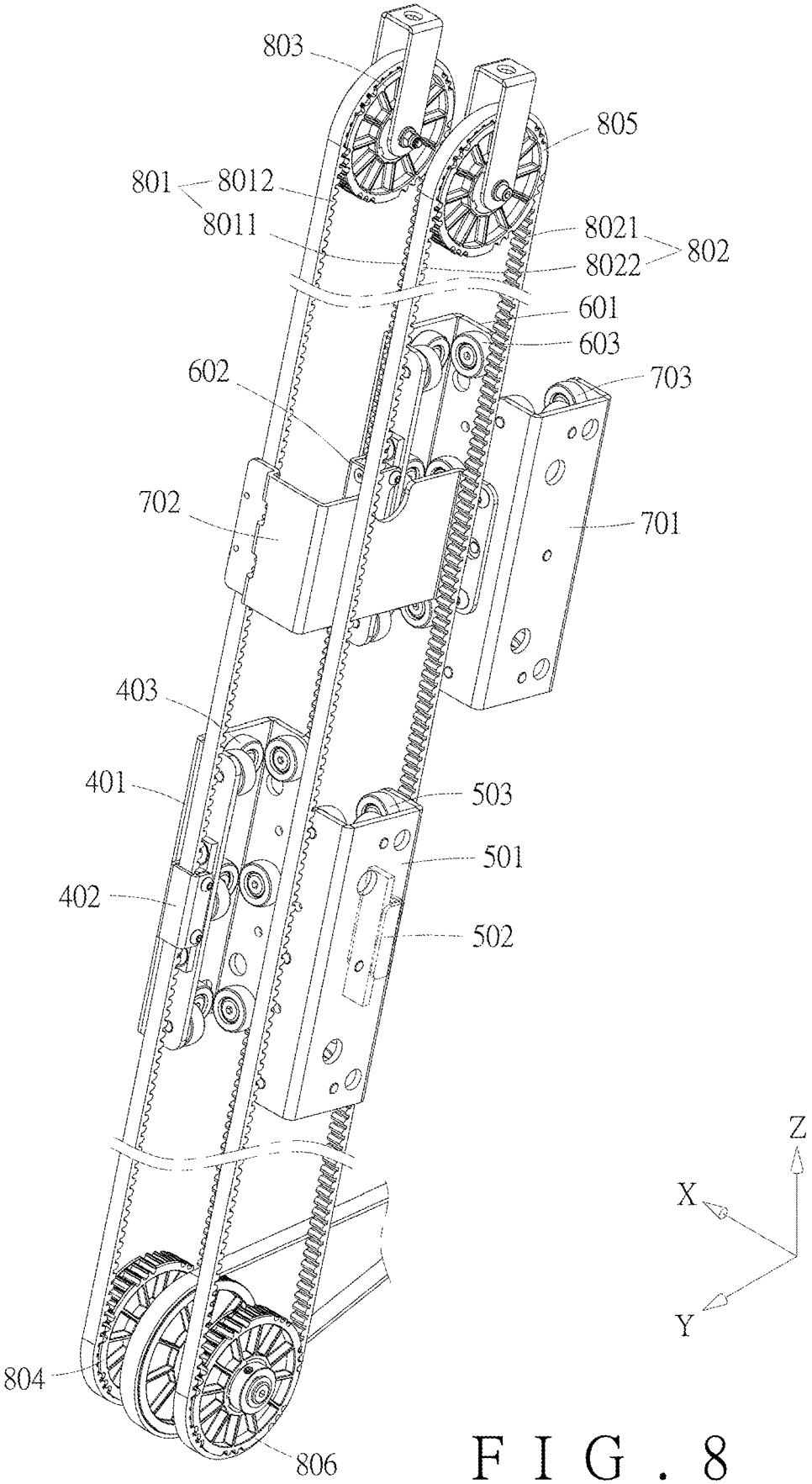
FIG. 8 is a second schematic view according to the first embodiment of the present invention, illustrating the first slide block, the second slide block, the third slide block and the fourth slide block that are coupled to the transmission unit.
Figure 9:
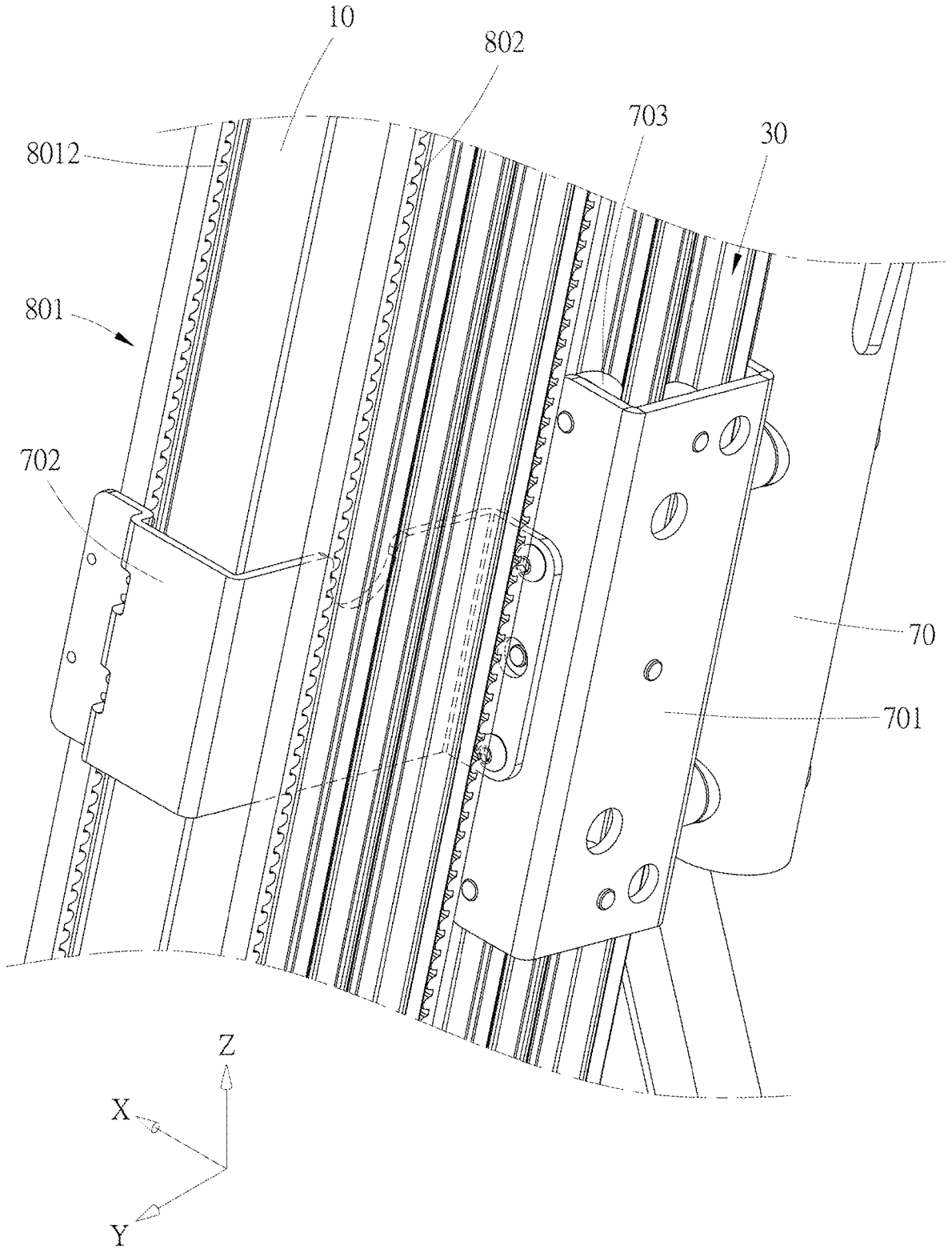
FIG. 9 is a partial enlarged view according to the first embodiment of the present invention, illustrating the connection relationship between the fourth slide block, the fourth connecting member and the first near section.
Figure 10:
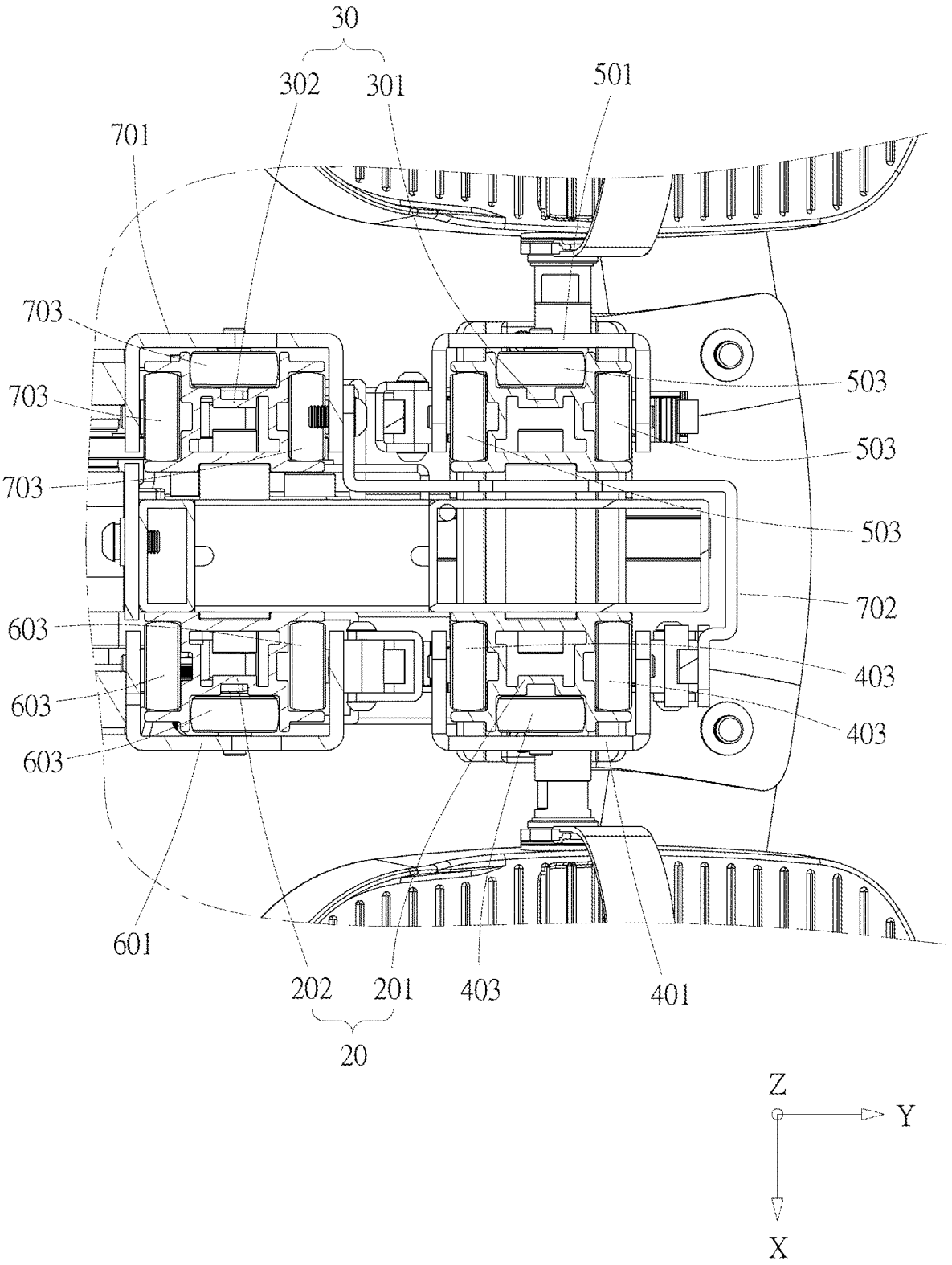
FIG. 10 is a top schematic view according to the first embodiment of the present invention, illustrating the arrangement between the first slide rail unit, the second slide rail unit and the rollers.

Please refer to FIGS. 8 to 10. The rollers 403, 503, 603, 703 roll in the first slide rail unit 20 and the second slide rail unit 30 respectively, so that the first slide block 401, the second slide block 501, the third slide block 601 and the fourth slide block 701 slide relative to the first slide rail unit 20 and the second slide rail unit 30, respectively.

Specifically, the first slide block 401 slides on the first near slide rail 201, the second slide block 501 slides on the second near slide rail 301, the third slide block 601 slides on the first far slide rail 202, and the fourth slide block 701 slides on the second far slide rail 302.

Through the rollers 403, 503, 603, 703, the first pedal 40, the second pedal 50, the first handle 60 and the second handle 70 can slide smoothly along the first slide rail unit 20 or the second slide rail unit 30, respectively.

Figure 11:
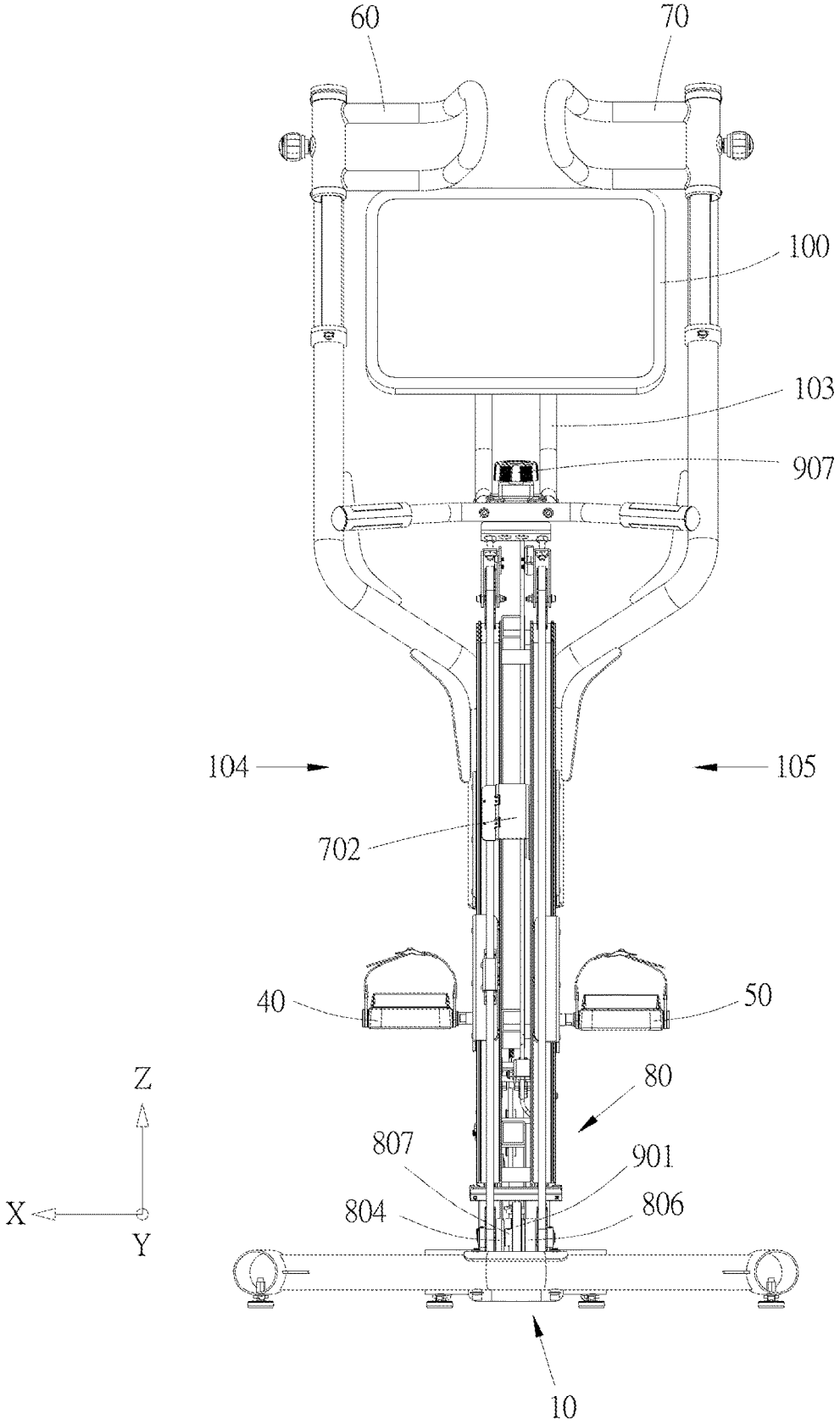
FIG. 11 is a first rear view according to the first embodiment of the present invention.
Figure 12:
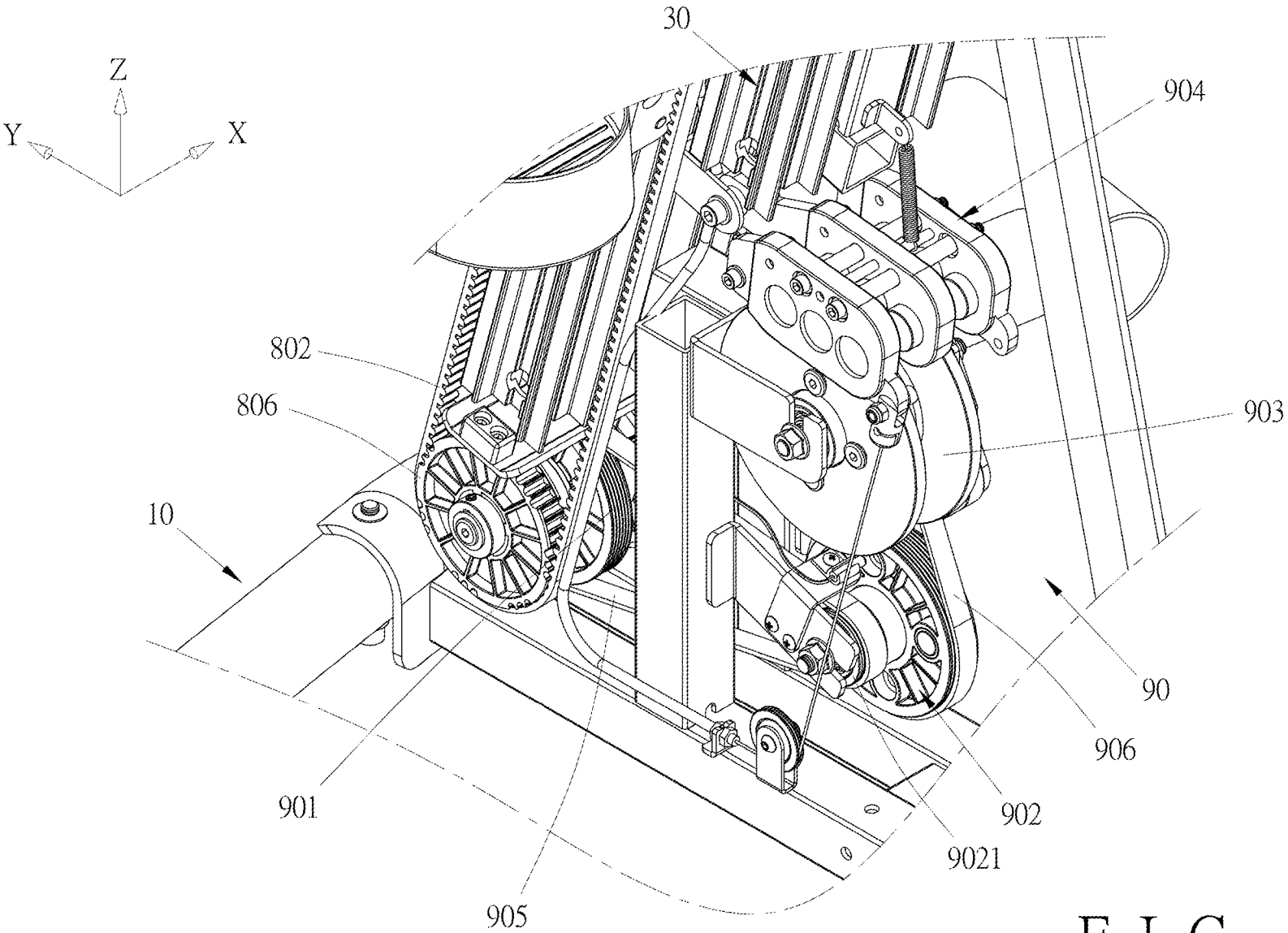
FIG. 12 is a partial enlarged view according to the first embodiment of the present invention, illustrating the resistance unit.
Figure 13:
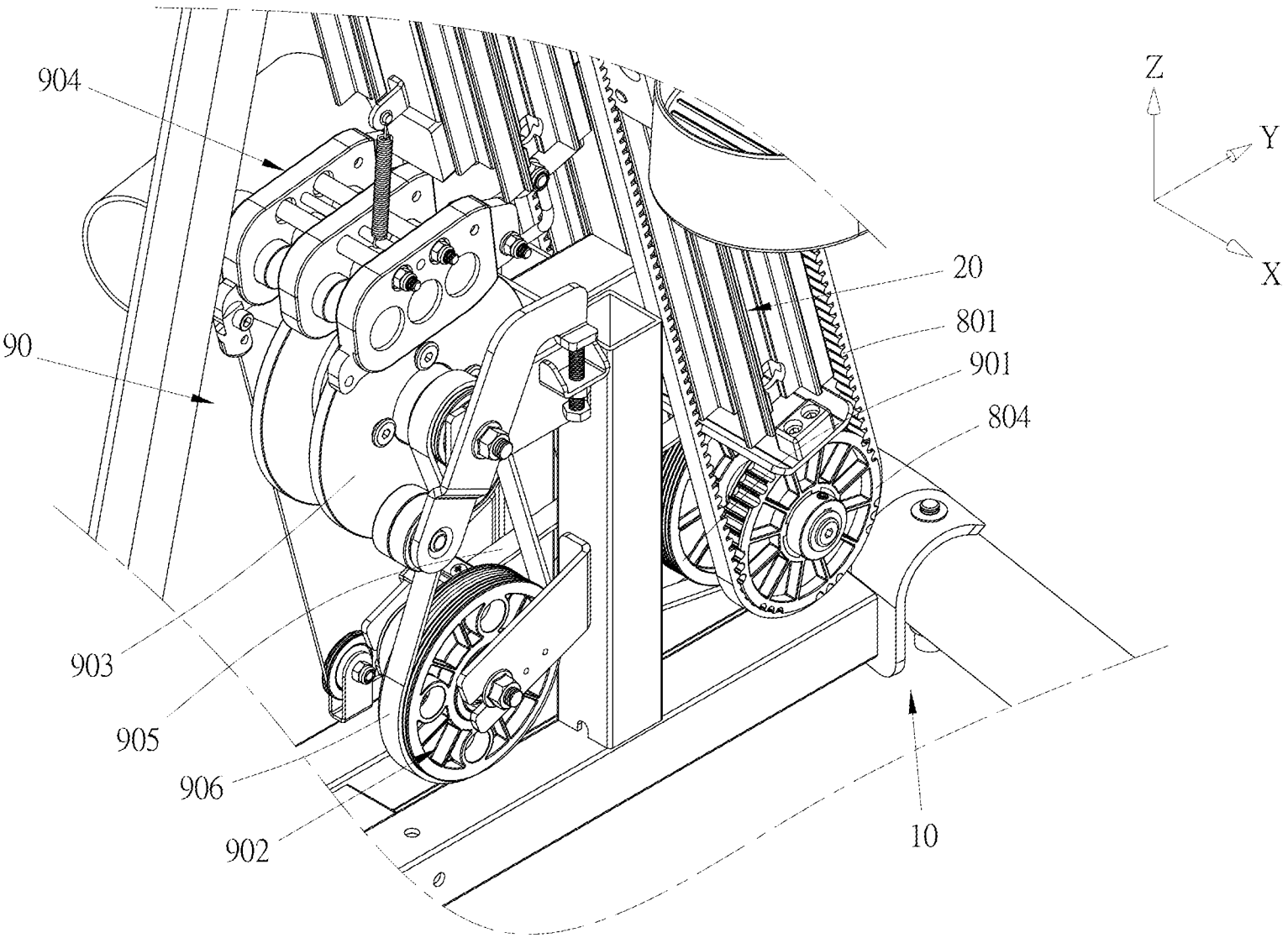
FIG. 13 is another partial enlarged view according to the first embodiment of the present invention, illustrating the resistance unit.
Figure 13A:
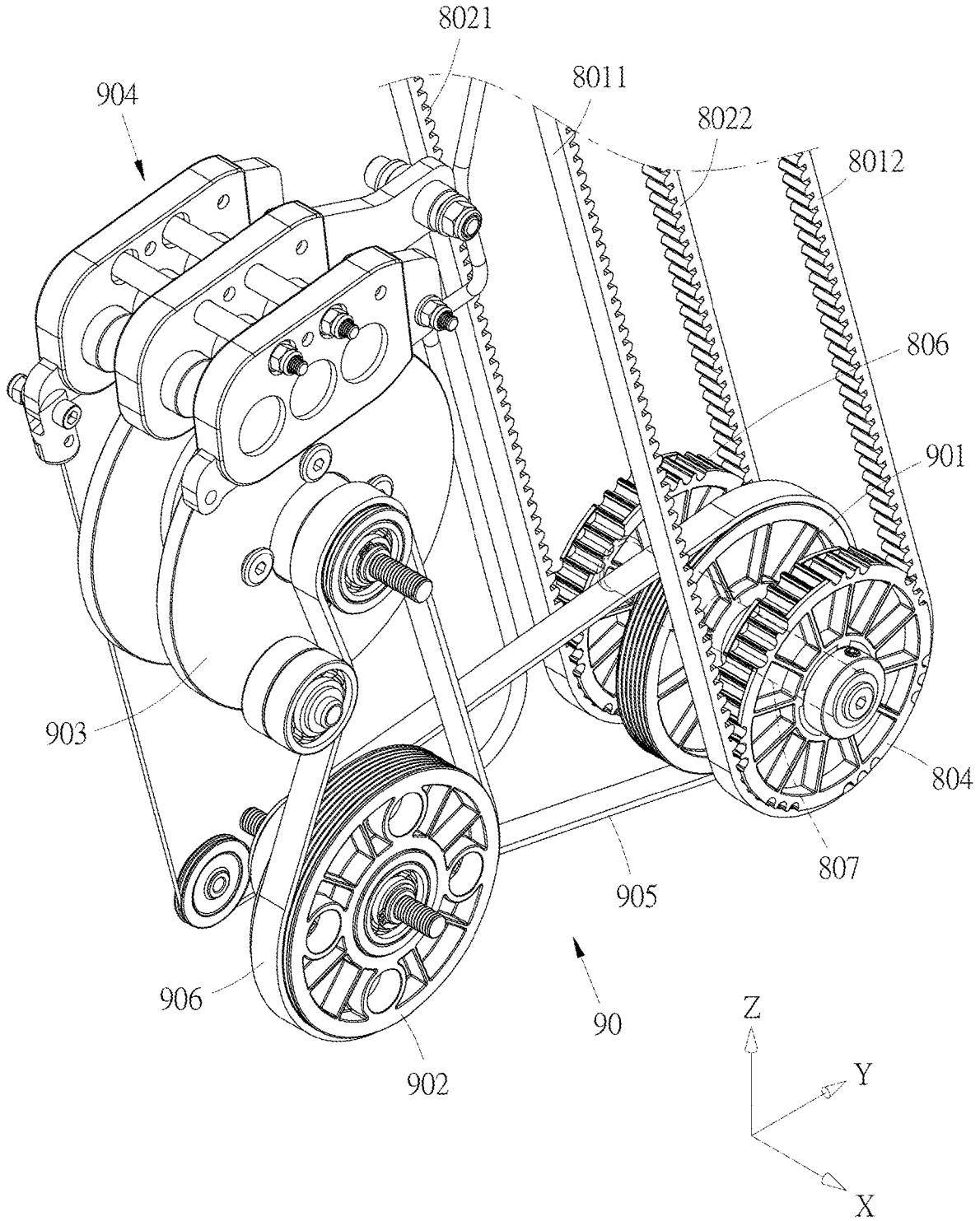
FIG. 13A is a schematic view showing the structure of the resistance unit according to the first embodiment of the present invention.

Please refer to FIG. 3 and FIG. 11. With the above configuration, the first pedal 40, the second pedal 50, the first handle 60 and the second handle 70 are all driven by the transmission unit 80 to slide back and forth on the first slide rail unit 20 and the second slide rail unit 30, respectively. Both the first pedal 40 and the first handle 60 are slidably disposed on the first side 104. Both the second pedal 50 and the second handle 70 are slidably disposed on the second side 105. The first pedal 40 and the second pedal 50 are adjacent in the X direction and have a distance from each other. The first handle 60 and the second handle 70 are adjacent in the X direction and have another distance from each other. Because the first slide rail unit 20 and the second slide rail unit 30 are arranged on the post 101, located in the center of the body of the operator A (referring to FIG. 14), so that they do not take up too much space. The operator A can operate the climbing machine structure more naturally.

Figure 7:
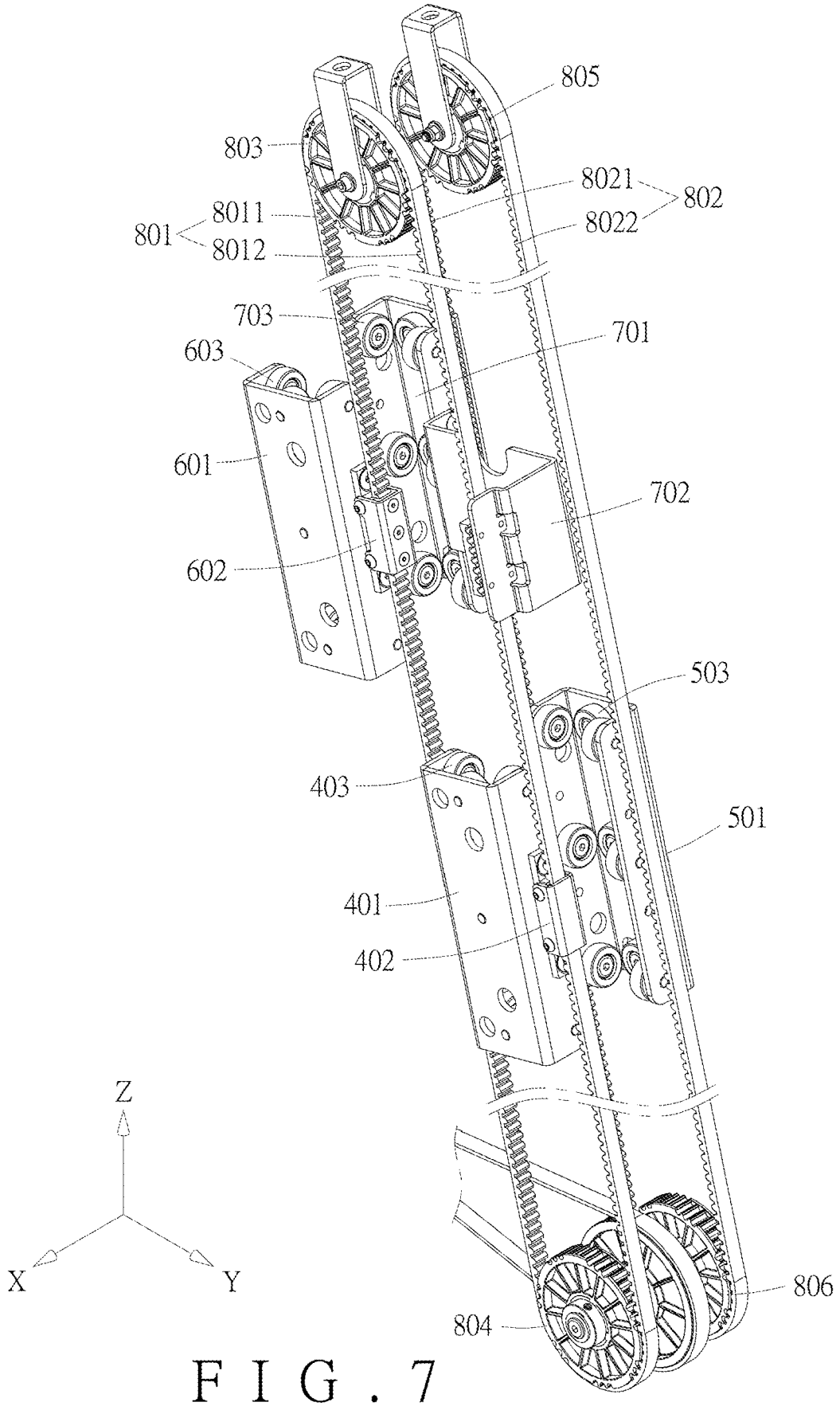
FIG. 7 is a second schematic view according to the first embodiment of the present invention, illustrating the first slide block, the second slide block, the third slide block and the fourth slide block that are coupled to the transmission unit.

Please refer to FIG. 7, FIG. 8 and FIG. 11. In operation, the left foot and the right foot of the operator A (referring to FIG. 14) alternately tread on the first and second pedals 40, 50. That is, when the operator A treads down on the first pedal 40 with his/her left foot, the first belt 801 will rotate accordingly, thereby driving the first pulley 803 and the second pulley 804 to rotate. At this time, because the second pulley 804 and the fourth pulley 806 are driven synchronously, the fourth pulley 806 will drive the second belt 802 and the third pulley 805 to rotate, so that the second pedal 50 and the first handle 60 are lifted. Similarly, when the operator A treads down on the second pedal 50 with his/her right foot, the first pedal 40 and the second handle 70 will be lifted through the actuation of the transmission unit 80. By treading on the first pedal 40 and the second pedal 50 in turn, the purpose of reciprocating motion can be achieved. In addition, the climbing machine structure allows the right hand and left foot of the operator A to move up and down synchronously as well as the left hand and right foot to move up and down synchronously. This is more in line with actual exercise habits.

Please refer to FIG. 6, FIG. 11, FIG. 12, FIG. 13 and FIG. 13A. The resistance unit 90 is disposed on the support frame 10. The resistance unit 90 includes a driving wheel 901, a driven wheel 902, a small driven wheel 9021, a resistance wheel 903, a resistance member 904, a third belt 905, a fourth belt 906 and a control member 907 for applying a resistance to the first pedal 40, the second pedal 50, the first handle 60 and the second handle 70, so as to enhance the training effect. The driving wheel 901 is connected to the rotating shaft 807. The driven wheel 902 and the small driven wheel 9021 are coaxial and rotated synchronously. The small driven wheel 9021 is connected with the driving wheel 901 via the third belt 905. The driven wheel 902 is connected with the resistance wheel 903 via the fourth belt 906. The resistance member 904 corresponds to the resistance wheel 903. Preferably, the resistance member 904 is a magnetic resistance member. The control member 907 is disposed on the support frame 10 and is connected to the resistance member 904. The position of the magnetic resistance member is controlled by the control member 907. The magnitude of the resistance is changed according to the needs of the operator A (referring to FIG. 14). The resistance wheel 903 of the present invention may adopt other resistance structures, such as friction resistance, wind resistance, water resistance, motor or electromagnetic brake, etc.

Please refer to FIG. 12, FIG. 13, FIG. 13A, and FIG. 14. More specifically, when the operator A treads on the first pedal 40 and the second pedal 50 in turn, the second pulley 804 and the fourth pulley 806 drive the driving wheel 901 to rotate, and the driving wheel 901 drives the resistance wheel 903 to rotate via the third belt 905, the small driven wheel 9021, the driven wheel 902 and the fourth belt 906. The resistance member 904 applies the resistance to the resistance wheel 903. The resistance is transmitted to the second pulley 804 and the fourth pulley 806 through the resistance unit 90. Then, the resistance is applied to the first pedal 40, the second pedal 50, the first handle 60 and the second handle 70.

Figure 15:
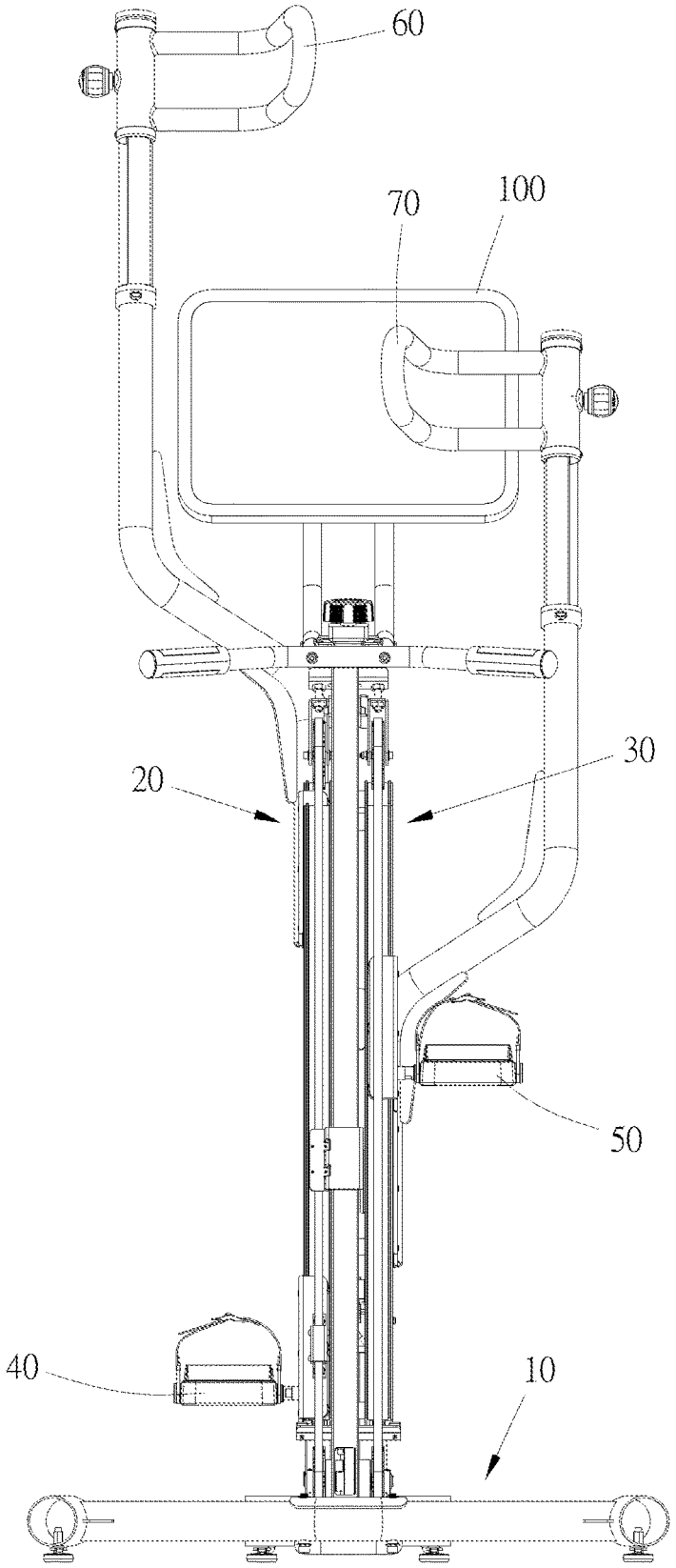
FIG. 15 is a second rear view according to the first embodiment of the present invention.

Please refer to FIG. 3, FIG. 14, and FIG. 15. Through the first slide rail unit 20 and the second slide rail unit 30 that are juxtaposed, the first top end 20*a*, the second top end 30*a* and the post top end 101*a* are not higher than the eye position of the operator A in the height direction. The line of sight of the operator A will not be blocked by the first slide rail unit 20, the second slide rail unit 30 and the post 101. No matter whether the display screen 100 is disposed on the climbing machine structure as in this embodiment, or a separate TV, projection screen, etc. is set, the operator A can watch the program easily. There is no need for the operator A to turn his/her head or watch the program obliquely.

Figure 16:
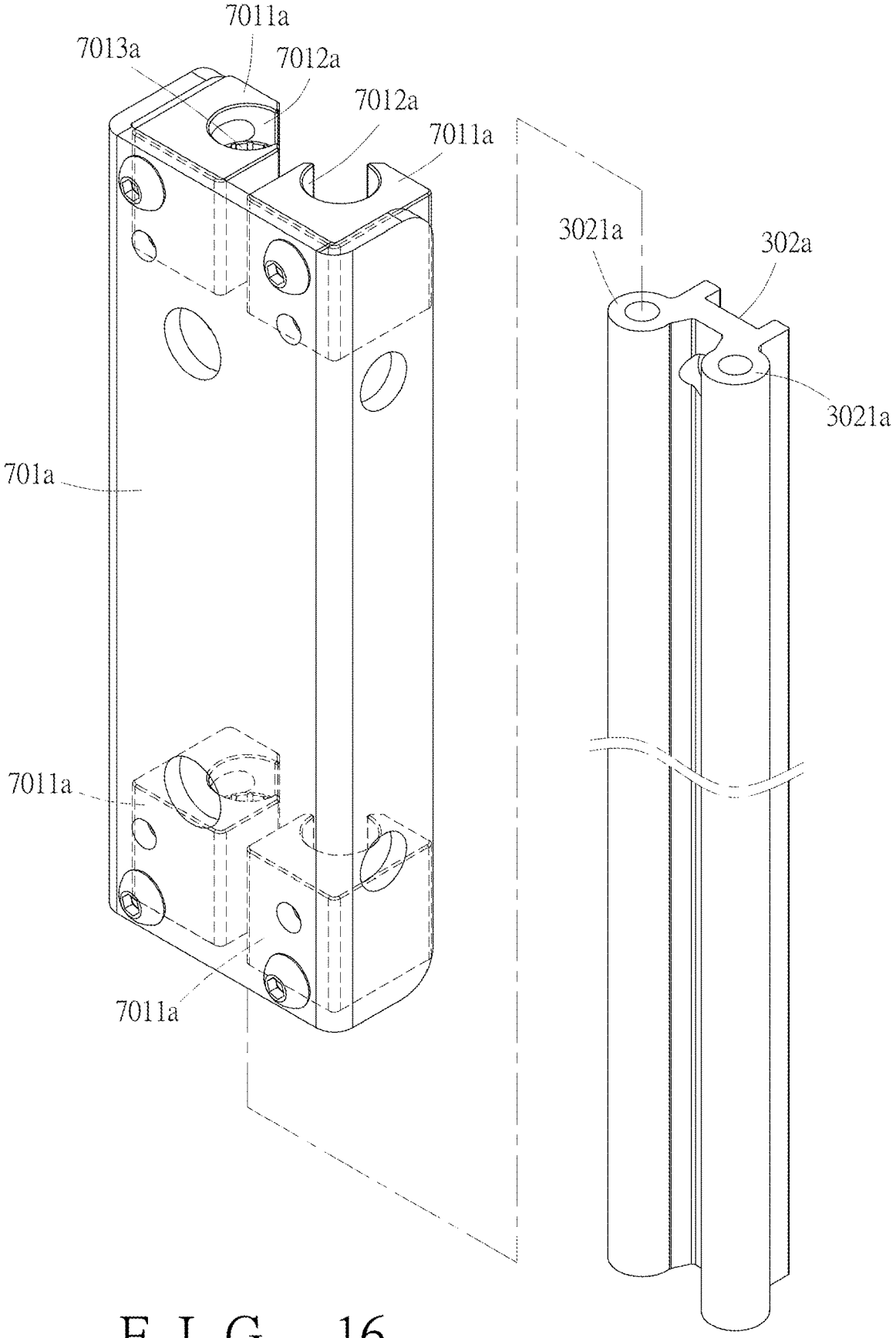
FIG. 16 is an exploded view according to a second embodiment of the present invention, illustrating different types of the fourth slide block and the second far slide rail.
Figure 17:
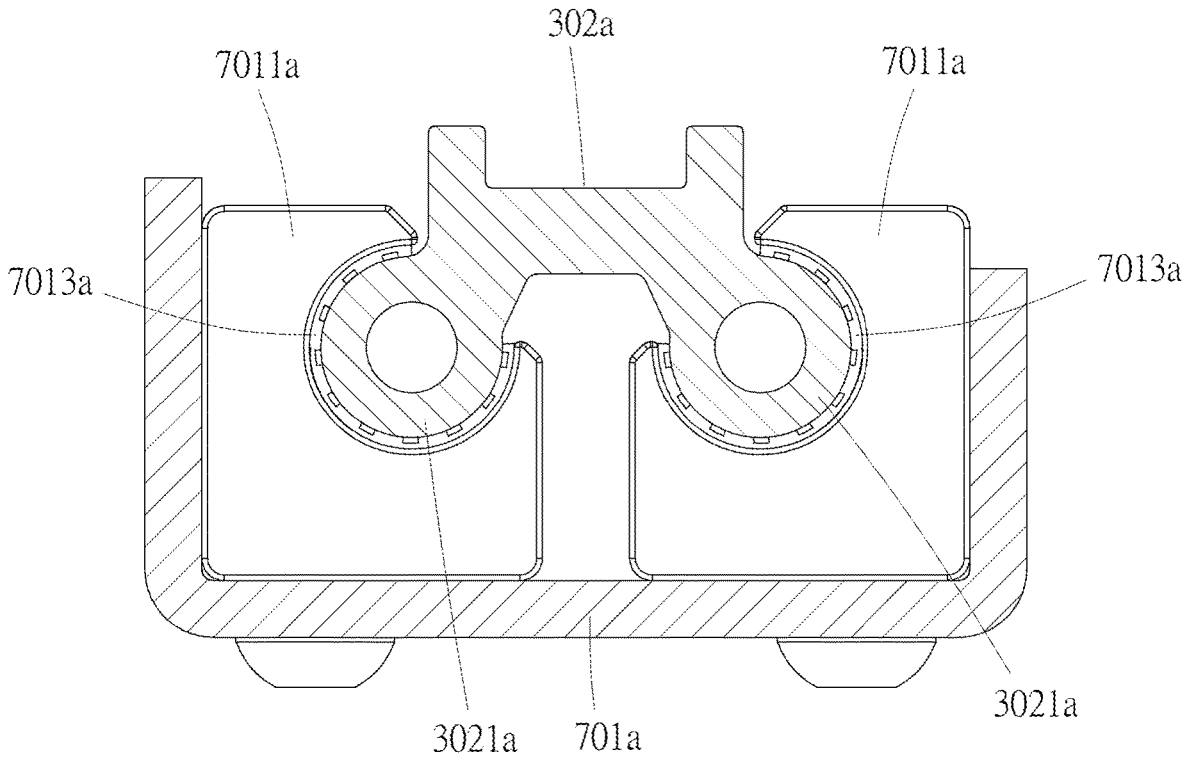
FIG. 17 is a cross-section of the fourth slide block and the second far slide rail according to the second embodiment of the present invention.

FIG. 16 and FIG. 17 illustrate a second embodiment of the climbing machine structure. For concise description, the fourth slide block 701*a* and the second far slide rail 302*a* are taken as an example for illustration in FIG. 16 and FIG. 17. The first slide block, the second slide block, the third slide block, the first near slide rail, the first far slide rail and the second near slide rail are not shown.

In the second embodiment, the second far slide rail 302*a* includes two tubular guide rails 3021*a* that are parallel to each other. Each of the four corners of the fourth slide block 701*a* is provided with a slide seat 7011*a*. The slide seat 7011*a* has a groove 7012*a* corresponding to the tubular guide rail 3021*a*. A bushing 7013*a* is fixed in the groove 7012*a*. The bushing 7013*a* is made of a wear-resistant material with low friction. The fourth slide block 701*a* slides on the second far slide rail 302*a* through the bushings 7013*a* sleeved on the respective tubular guide rails 3021*a*.

In actual implementation, viewed from the cross-sectional direction of the slide seat 7011*a* perpendicular to the axial direction, the cross-sectional profile of the groove 7012*a* is approximately three-quarters of the circumference, so that it can embrace the tubular guide rail 3021*a* to slide smoothly.

The other structures of the second embodiment are the same as the corresponding structures of the first embodiment, and will not be repeated hereinafter.

The first embodiment adopts a roller-type slide member, such as the roller 403, 503, 603, 703 as shown in FIG. 10. The second embodiment adopts a bushing-type slide member, such as the bushing 7013*a* as shown in FIG. 17. Of course, it is also a feasible embodiment of the present invention to adopt the roller-type slide member and bushing-type slide member in combination.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A climbing machine structure for use by an operator in a standing position, the climbing machine structure comprising:

a support frame having a first side and a second side;

a first slide rail unit disposed on the first side of the support frame and having a first top end;

a second slide rail unit disposed on the second side of the support frame and having a second top end, wherein the first slide rail unit and the second slide rail unit are each configured to respectively position the first top end and the second top end at an elevation lower than a position of the operator's eyes;

a first pedal slidably connected to the first slide rail unit;

a second pedal slidably connected to the second slide rail unit;

a first handle slidably connected to the first slide rail unit;

a second handle slidably connected to the second slide rail unit; and a transmission unit disposed on the first side and the second side of the support frame, the transmission unit including a first belt and a second belt linked with each other, the first belt and the second belt being looped along a height direction to be moved relative to the support frame, wherein the first pedal, the second pedal, the first handle, and the second handle are connected to the first belt and the second belt respectively, whereby the first pedal, the second pedal, the first handle, and the second handle are driven by the transmission unit to slide back and forth on the first slide rail unit and the second slide rail unit respectively, the transmission unit further including a first pulley, a second pulley, a third pulley, a fourth pulley, and a rotating shaft, the first pulley and the second pulley are located on the first side of the support frame, the third pulley and the fourth pulley are located on the second side of the support frame, the first belt is looped around the first pulley and the second pulley, the second belt is looped around the third pulley and the fourth pulley, the second pulley and the fourth pulley are connected to the rotating shaft to rotate back and forth synchronously, and the rotating shaft is disposed on the support frame and is rotatable relative to the support frame, wherein the first belt includes a first far section and a first near section, the first far section is configured to be spaced away from the operator, the first near section is configured to be close to the operator, the first far section and the first near section are moved in opposite directions; the second belt includes a second far section and a second near section, the second far section is configured to be spaced away from the operator, the second near section is configured to be close to the operator, the second far section and the second near section are moved in opposite directions; the first pedal is provided with a first slide block, the first slide block is connected to the first near section through a first connecting member, the second pedal is provided with a second slide block, second slide block is connected to the second far section through a second connecting member, the first handle is provided with a third slide block, the third slide block is connected to the first far section through a third connecting member, the second handle is provided with a fourth slide block, and the fourth slide block is connected to the first near section through a fourth connecting member.

2. The climbing machine structure as claimed in claim 1, wherein the first slide rail unit includes a first near slide rail and a first far slide rail, the first near slide rail is configured to be close to the operator, the first far slide rail is configured to be spaced away from the operator, the second slide rail unit includes a second near slide rail and a second far slide rail, the second near slide rail is configured to be close to the operator, the second far slide rail is configured to be away from the operator; the first slide block slides on the first near slide rail, the second slide block slides on the second near slide rail, the third slide block slides on the first far slide rail, and the fourth slide block slides on the second far slide rail.

3. The climbing machine structure as claimed in claim 2, wherein the first slide block, the second slide block, the third slide block, and the fourth slide block each include at least one roller; each at least one roller is configured to roll in a corresponding one of the first slide rail unit or the second slide rail unit, thereby the first slide block, the second slide block, the third slide block, and the fourth slide block slide relative to the first slide rail unit and the second slide rail unit, respectively.

4. The climbing machine structure as claimed in claim 2, wherein the first slide block, the second slide block, the third slide block, and the fourth slide block each include at least one bushing; each at least one bushing is configured to be sleeved on a corresponding one of the first slide rail unit or the second slide rail unit, thereby the first slide block, the second slide block, the third slide block, and the fourth slide block slide relative to the first slide rail unit and the second slide rail unit, respectively.

5. The climbing machine structure as claimed in claim 1, further comprising a resistance unit disposed on the support frame, the resistance unit including a driving wheel, a first driven wheel, a second driven wheel smaller than the first driven wheel, a resistance wheel, a third belt, a fourth belt and a resistance member, the driving wheel being connected to the rotating shaft, the first driven wheel and the second driven wheel being coaxial and rotated synchronously, the second driven wheel being connected with the driving wheel via the third belt, the first driven wheel being connected with the resistance wheel via the fourth belt, the resistance member being movable relative to the resistance wheel; the second pulley and the fourth pulley driving the driving wheel to rotate back and forth through the rotating shaft, the driving wheel driving the resistance wheel to rotate through the third belt, the second driven wheel, the first driven wheel and the fourth belt; the resistance member being configured to apply a resistance to the resistance wheel, the resistance being transmitted to the second pulley and the fourth pulley through the fourth belt, the first driven wheel, the second driven wheel, the third belt, and the driving wheel, the resistance being further applied to the first pedal, the second pedal, the first handle, and the second handle.

6. The climbing machine structure as claimed in claim 5, wherein the resistance member is a magnetic resistance member, the resistance unit further includes a control member disposed on the support frame, the control member is connected to the magnetic resistance member; and a position of the magnetic resistance member is controlled by the control member to change a magnitude of the resistance.

7. The climbing machine structure as claimed in claim 1, wherein the support frame further includes a display screen stand, a display screen is disposed on the display screen stand, and the display screen is configured to correspond in height to a position of the operator's eyes.

8. The climbing machine structure as claimed in claim 1, wherein the support frame includes a post and a base, the height direction is a Z direction, an X direction and a Y direction are perpendicular to the Z direction, the X direction and the Y direction are perpendicular to each other, the X direction and the Y direction constitute an XY plane, the post extends obliquely along the Z direction, the post has a post top end, the post top end being positioned at an elevation lower than a position of the operator's eyes, the base is located on the XY plane, the first slide rail unit and the second slide rail unit are disposed on the post, the first pedal and the second pedal are spaced by a distance in the X direction, and the first handle and the second handle are spaced by another distance in the X direction.

* * * * *